US006637158B2

(12) United States Patent
Bennett

(10) Patent No.: US 6,637,158 B2
(45) Date of Patent: Oct. 28, 2003

(54) LEAK RESISTANT ENTRYWAY ASSEMBLY WITH ANTI-WICKING WEATHER STRIPS

(75) Inventor: Joel Bennett, Greensboro, NC (US)

(73) Assignee: Endura Products, Inc., Greensboro, NC (US)

( * ) Notice: Subject to any disclaimer, the term of this patent is extended or adjusted under 35 U.S.C. 154(b) by 0 days.

(21) Appl. No.: 09/952,655

(22) Filed: Sep. 14, 2001

(65) Prior Publication Data

US 2002/0069589 A1 Jun. 13, 2002

Related U.S. Application Data

(60) Provisional application No. 60/233,200, filed on Sep. 15, 2000.

(51) Int. Cl.[7] ..... E06B 1/04
(52) U.S. Cl. ..... 49/504; 49/471; 52/204.1
(58) Field of Search ..... 49/467, 469, 471, 49/504; 52/204.1, 211, 209

(56) References Cited

U.S. PATENT DOCUMENTS 3,591,985 A * 7/1971 Coppins ..... 49/504
3,851,420 A * 12/1974 Tibbetts ..... 49/471
4,055,917 A * 11/1977 Coller ..... 49/469
4,447,987 A * 5/1984 Lesosky ..... 49/469
4,513,536 A * 4/1985 Giguere ..... 49/471
4,831,779 A * 5/1989 Kehrli et al. ..... 49/471
5,018,307 A * 5/1991 Burrous et al. ..... 49/471
6,125,599 A * 10/2000 Mees et al. ..... 52/204.5
6,161,343 A * 12/2000 Young ..... 52/97

* cited by examiner

*Primary Examiner*—Jerry Redman
(74) *Attorney, Agent, or Firm*—Womble Carlyle Sandridge & Rice, PLLC

(57) ABSTRACT

An entryway system includes an elongated threshold assembly and a pair of plastic jamb boots attached to the ends of the threshold assembly. The jamb boots have flat level upper surfaces and a pair of jambs having square-cut bottoms are secured to the jamb boots and extend upwardly from the threshold assembly. A head jamb completes a door frame. The jamb boots are formed with integral drains that receive water from within the threshold cap channel of the threshold assembly and direct it away from the entryway. The plastic jamb boots prevent rotting and eliminate the need to mill the bottoms of jambs with haunches configured to fit the threshold assembly. Stops are provided in one embodiment at the bottoms of the weather strip kurfs to position the bottom ends of weather strips above the sill of the threshold to prevent weather strip wicking and consequent leakage in wind-blown rains.

3 Claims, 7 Drawing Sheets

LEAK RESISTANT ENTRYWAY ASSEMBLY WITH ANTI-WICKING WEATHER STRIPS

REFERENCE TO RELATED APPLICATION

The filing date of U.S. provisional patent application Ser. No. 60/233,200 filed on Sep. 15, 2000 is hereby claimed.

TECHNICAL FIELD

This invention relates generally to entryway systems for homes and commercial buildings and more specifically to entryways incorporating continuous threshold assemblies and leak resistance.

BACKGROUND

Entryway systems used in building construction generally include a pair of vertically extending door jambs and a head jamb that frame the entryway and receive a hinged door. An elongated threshold assembly is attached at its ends to the bottoms of the door jambs and spans the bottom of the entryway. Many modern threshold assemblies include an extruded aluminum frame having an upwardly open channel from which a sill slopes outwardly and downwardly. A threshold cap, which may be made of plastic or wood, is disposed in the upwardly open channel and underlies a closed door mounted of the entryway. The threshold cap usually is vertically adjustable to engage and form a seal with a flexible sweep attached to the bottom of the door.

Some entryways include sidelights that flank the door on one or both sides thereof. In such sidelight entryways, mullions or mull posts extend vertically from the top of the threshold assembly to the head jamb to define the door opening and sidelight openings. Many variations of this basic theme such as, for example, patio door entryways, inswing entryways, and outswing entryways, are available to accommodate an equal number of variations of entryway designs.

Traditionally, the bottoms of door jambs, which usually are made of wood, are attached to the ends of the threshold assembly by milling a specially shaped jamb haunch in the bottoms of the jambs and fitting and stapling the bottoms of the jambs to the threshold assembly. A portion of the haunch overlaps and sits atop the sloped sill of the threshold assembly. The problems with this traditional technique are many. For instance, since virtually every brand and style of threshold assembly has a different shape, the jamb haunches in each case must be precisely and specially milled to fit the particular threshold assembly to which they are to be attached. This means that pre-hangers must own and operate expensive and accurate milling machinery and must maintain a number of different shaped milling cutters to accommodate the various configurations of threshold assemblies. This is also true for the bottoms of mull posts, which must be provided with a haunch specially shaped to rest atop the jamb of the threshold assembly. Another problem is that, since the end grain of the jambs and mull posts rests directly on the sill deck, moisture from rain water and the like eventually leaks beneath the haunch and wicks into the wood of the jambs and mull posts causing rot and decay. Finally, water that may seep under the threshold cap of the assembly and into the upwardly open channel that holds it tends to migrate to and puddle at the ends of the channel, where it soaks into the wood of the jambs also causing eventual rot and deterioration.

Another leakage problem that commonly occurs with traditional and modern entryway systems involves the leaking of water into a building structure at the bottom corners of a closed door. Entryways are especially susceptible to such leakage in a blowing rainstorm where water may collect on the sill of a threshold and be forced between the door, threshold, and jamb under the influence of air or wind pressure created by the wind. Manufacturers of entryway systems have attempted to address leakage at this location in a number of ways. One solution sometimes found in modern entryways is a flexible corner pad on the bottom of the jamb where the jamb meets the threshold cap. The theory is that the corner pad will fill the space between the door and the jamb, thus sealing against leakage of water at this location. FIG. 6 attached hereto illustrates a section of a modern entryway system provided with such a corner pad and further illustrates the reason why such corner pads have not met with complete success.

FIGS. 6 and 6*a* illustrate the portion of an entryway system where the threshold assembly 70 of the entryway meets the vertical jamb 71 thereof. The threshold 70 has a sloped sill 72 and a threshold cap 73. The bottom of the jamb 71 is milled to form an appropriate haunch to fit the profile of the threshold 70 and is attached thereto with appropriate fasteners (not shown). As best illustrated in FIG. 6*a*, the vertical jamb 71 is milled to form a vertically extending stop 78 against which the door 79 of the entryway closes when shut. The stop 78 further is formed with a kurf 77. A length of flexible weather strip 74 is mounted to the stop 78 by means of a locking tongue assembly 76 that extends into the kurf 77. With this configuration, the weather strip 74 is collapsed and compressed between the door 79 and the stop 78 around the periphery of the door when the door is shut. The bottom end of the weather strip in traditional entryway systems extends below the bottom edge of the door and rests on the sloped sill of the threshold as best illustrated in FIG. 6.

As mentioned above, entryway manufacturers for some time have attempted to prevent leakage at the bottom corner of a door by installing flexible corner pads, illustrated at 75 in FIG. 6. Such corner pads may have lobes that extend behind the weather strip 74 to reinforce the weather strip and, it is thought, form a tighter seal between the weather strip and the door at the bottom of the entryway. However, it has been discovered that leakage still occurs at this location, particularly under conditions of blowing rainstorms. Under such conditions, rain water 81 tends to collect on the sill 72 and puddle at the corners of the entryway. In addition, the wind in a blowing rainstorm generates wind pressure (illustrated with arrows in FIG. 6) that is greater than the pressure within the dwelling on the other side of the door and that rises in proportion to the strength of the blowing wind.

As shown in FIG. 6, it has been discovered that, under such conditions, leakage still occurs at the bottom corners of the door regardless of the integrity of the seal created between the weather strip and the door and between the door and the corner pad. Observation and experimentation has demonstrated that such leakage occurs as a result of weather strip wicking and not as a result of a poor seal between the weather strip and the door or the corner pad and the door. Specifically, when the door is shut against the weather strip, the weather strip folds to create its seal and this folding also forms a capillary channel 100 (FIG. 6*a*), similar to a straw, that extends along the length of the weather strip. High external wind pressure generated by blowing wind pushes water 81 up into the capillary channel in the weather strip as shown in FIG. 6. As the external air pressure increases relative to the internal pressure within the building, the water is forced higher into the capillary channel formed by the folded weather strip, eventually rising over the top of the corner pad and leaking into the building. Thus, it is now clear that corner pads have been at least partially a misguided attempt to address the problem of leakage at the lower corners of a closed door.

Thus, a need exists for an improved entryway system that addresses and solves the above-referenced problems and shortcomings of the prior art. Such an entryway system should eliminate the need for specially milled jamb and mull post haunches to fit these elements to the threshold assembly, should eliminate the rotting and deterioration that typically occurs at the bottoms of jambs and mull posts where they meet the threshold assembly, and should provide for the efficient draining off of water that may seep beneath the threshold cap of the threshold assembly. A further need exists for an entryway system that effectively and reliably stops water leakage at the bottom corners of a closed door of the entryway. It is to the provision of such an entryway system that the present invention is primarily directed.

SUMMARY OF THE INVENTION

Briefly described, the present invention, in one preferred embodiment thereof, comprises an improved entryway system that eliminates the aformentioned problems with traditional prior art entryways. The entryway system comprises an elongated threshold assembly that preferably is made of extruded aluminum formed with a downwardly and outwardly sloping sill and an upwardly open channel. A vertically adjustable threshold cap is disposed in the channel for underlying a closed door of the entryway. A jamb boot is attached to each end of the threshold assembly for receiving and mating with the bottom of a respective one of the door jambs of the entryway. Each jamb boot preferably, but not necessarily, is made of injection molded plastic and is preformed with a haunch that is configured precisely to fit the particular threshold assembly to which it is attached. Each jamb boot is shaped with the same vertical profile as its corresponding door jamb and has an upper surface that is flat and level. The jamb boots are pre-attached and sealed to the ends of the threshold assembly by the threshold assembly manufacturer. At the pre-hanger's facilities, jambs are prepared for attachment to the threshold assembly simply by square cutting the bottoms of the jambs, mating the jamb bottoms to the flat level top surface of their corresponding jamb boots, and attaching the jambs to their boots with screws extending through the bottom of the jamb boots and into the jambs.

Each of the jamb boots is further formed in one embodiment with an internal drain channel that receives collected water from the upwardly open channel of the sill and directs the water to the outside face of the jamb boot. Thus, water that may seep beneath the threshold cap is harmlessly drained away and does not collect beneath the threshold cap.

The invention also includes injection molded plastic or composite mull post boots for use with sidelight entryways. The mull post boots also are pre-formed with a haunch that precisely matches and sits atop the sill and each has a level top surface. Mull posts are attached to the threshold assembly by square cutting their bottoms, mating the bottoms of the mull posts with the flat level tops of the mull post boots, and attaching the mull posts with screws extending through the mull post boots from below. A traditional head jamb or header is attached to the tops of the jambs and mull posts in the traditional way and a door is hung in the resulting frame in the traditional way to complete the pre-hanging process.

The invention further includes means for positively arresting the leakage of rainwater into a building at the lower corners of a closed door. This is accomplished by providing a weather strip along each jamb that has a bottom end adjacent the threshold that is raised above the level of the sill to prevent weather strip wicking and consequent leakage. In one embodiment for use with traditional milled jambs, a positioning insert is provided in the bottom of the kurf of the jamb into which the locking tongue of the weather strip extends and is fixed. The positioning insert limits the position of the bottom end of the weather strip to a location above the sill so that water collected on the sill does not contact the bottom of the weather strip and thus cannot be blown by air pressure up the capillary channel formed therein. In another embodiment for use with the jamb boots of the present invention, the jamb boot is formed without a continuation of the jamb kurf, thus forming a stop. The stop, like the positioning insert, limits the position of the bottom of the weather strip to a location above the sill to prevent wicking in conditions of blowing rain. It has been found that raising the bottom of the weather strip above the sill away from puddling water substantially eliminates leakage of water at the lower corners of a closed door even under conditions of blowing rains and high winds.

Thus, a unique entryway system is now provided that eliminates the requirement to mill the bottoms of door jambs and mull posts with specially configured haunches to match the particular threshold assembly being used in the entryway. Since the jamb and mull post boots of the invention are formed of plastic, water that may collect or seep beneath their haunches never reaches the wood of the jambs and mull posts. Accordingly, rotting and deterioration common with traditional entryway systems is eliminated. The draining feature of the jamb boots ensures that water does not collect in the channel beneath the threshold cap of the threshold assembly. Finally, raising the bottom end of the weather strip above the sill deck effectively stops leakage of water at the bottom corners of a closed door caused by weather strip wicking. These and other features, objects, and advantages of the entryway system of this invention will become more apparent upon review of the detailed description set for below when taken in conjunction with the accompanying drawings, which are briefly described as follows.

DETAILED DESCRIPTION OF THE PREFERRED EMBODIMENTS

Figure 1:
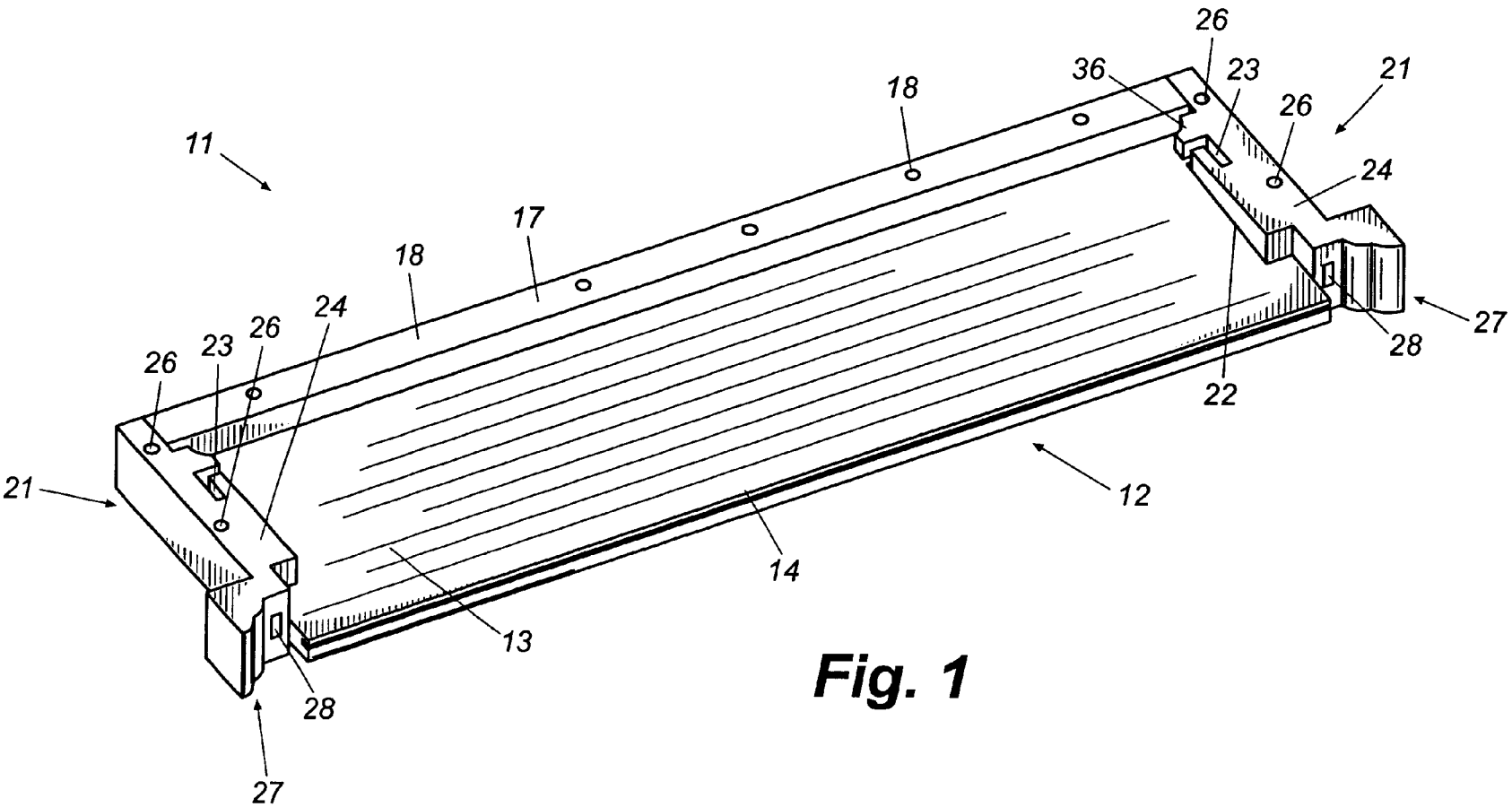
FIG. 1 is a perspective view of a threshold assembly with attached jamb boots that embodies principles of the present invention in a preferred form.

Referring now in more detail to the drawings, in which like numerals refer to like parts throughout the several views, FIG. 1 illustrates a threshold assembly for use in an entryway system that embodies principles of the invention. The threshold assembly 11 comprises an extruded aluminum frame 12 formed to define an upwardly open channel 16 (FIG. 4) from which a sill 13 slopes downwardly to a forward edge 14. A threshold cap 17 is disposed in the channel 16 for underlying a closed door of the entryway and includes an array of adjustment screw access ports 18 for adjusting the vertical position of the threshold cap within the channel. The ends 19 (FIG. 2) of the frame are cut square.

A jamb boot 21 is attached to each end 19 of the elongated frame 12 and each jamb boot preferably is injection molded from an appropriate plastic or composite material to resist rot and decay caused by moisture. Each jamb boot 21 is formed with a jamb haunch 22 that is sized and configured to overlap and sit atop the end portion of the sill deck just as does the milled haunch on the bottom end of a traditional wood jamb. In the embodiment of FIG. 1, a weather strip slot or kurf 23 is formed in the jamb boot for receiving the bottom end of a length of weather strip as described in more detail below. Further, a weather strip stiffener 36 is formed in the jamb boot 21 of FIG. 1 for stiffening the weather strip at the critical bottom corner of the entryway to resist migration of moisture through the entryway when the door is shut.

The jamb boot 21 is formed with a flat, level top face 24 and with a forward edge portion 27 that is shaped to match the contours of a traditional brick mold. A pair of screw holes 26 are formed through the jamb boot for securing the boot to the bottom of a wooden jamb, as detailed below. The jamb boot may be formed with an internal drain channel (not visible in FIG. 1) that terminates at the forward edge of the boot in a drain port 28.

Figure 2:
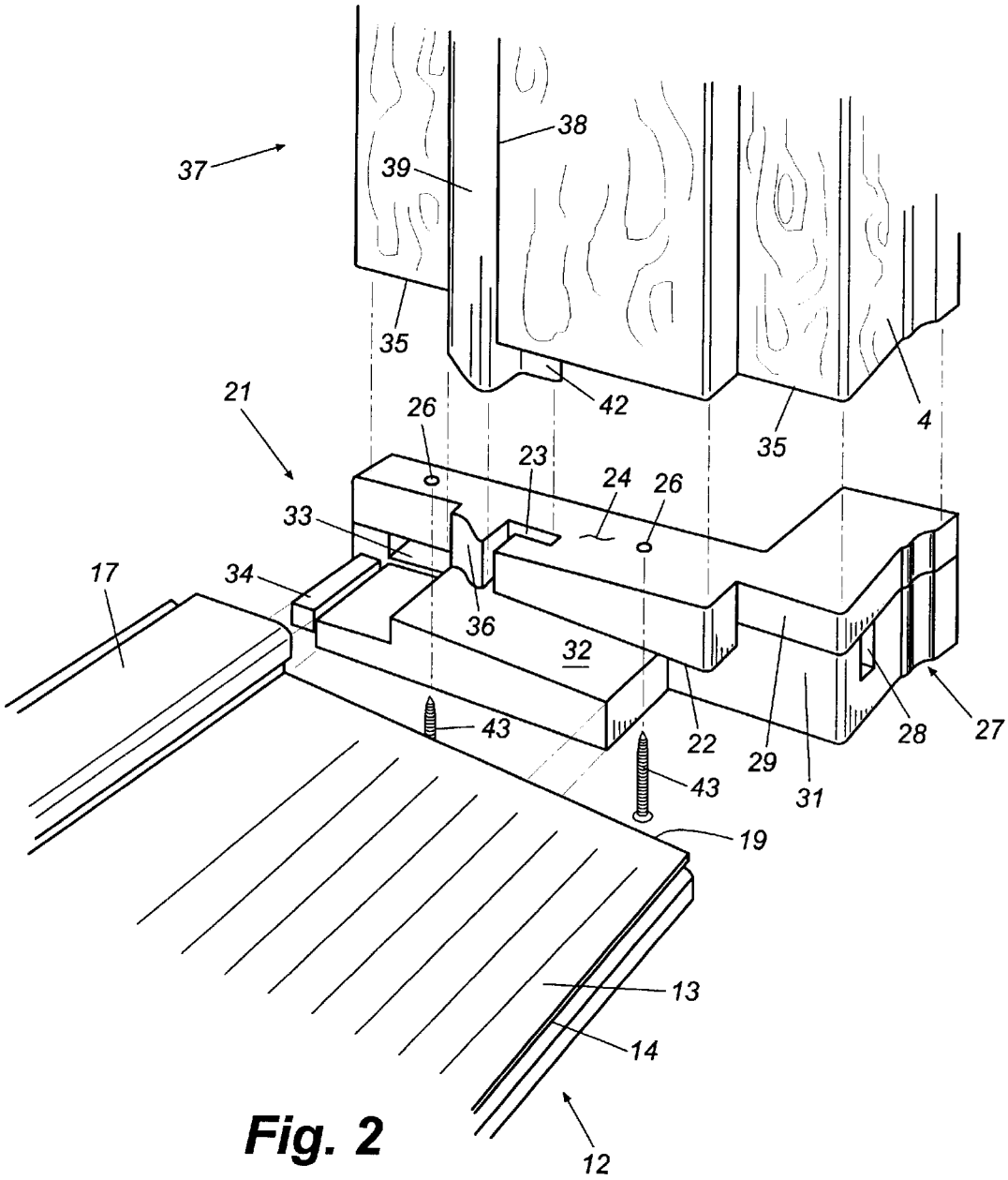
FIG. 2 is a perspective exploded view of one end of the threshold assembly of FIG. 1 showing the configuration of the jamb boot in detail and the attachment of the boot to the threshold assembly and the jamb to the boot.

Referring to FIG. 2, the end portion of the threshold frame 12 is illustrated with its sill 13 terminating in forward edge 14 and with a square cut end 19. The threshold cap 17 resides in the upwardly open channel 16 (FIG. 4) of the frame and is vertically adjustable as described above. Jamb boot 21 is illustrated in more detail in FIG. 2 and is seen to be formed from an upper section 29 and a lower section 31 appropriately aligned and secured together. The lower section 31 is formed with a support and attachment block 32, which is sized and configured to be received within a corresponding channel (not visible) extruded on the bottom portion of the frame 12 and secured thereto with staples, adhesives, or other appropriate fasteners. In fact, the support and attachment block takes the place of the common wooden or composite reinforcement block that traditionally is installed and fastened in the ends of the threshold frame. A filler block 34 may also be provided, depending upon the profile of the frame, to be received in and fill appropriate voids in the end portion of the frame. As detailed below, the lower portion 31 of the jamb boot is formed with an internal drain channel that terminates in a drain port 28 at the forward edge of the boot and that originates with a drain mouth 33 at the rear portion of the lower section 31.

The upper portion 29 of the jamb boot is secured atop the lower portion with appropriate adhesive or other fastening means and is formed with a haunch 22 having an angled bottom surface that overlaps and sits atop the deck of the sill 13 when the jamb boot is secured to the frame. This mimics the configuration of the traditional milled jamb boot on the bottom of a wooden jamb. The upper portion 29 in this embodiment is further formed with a weather strip slot 23 and an associated weather strip stiffener 36, the function of which is described in more detail below. Screw holes 26 extend through the jamb boot from the bottom surface to the top surface thereof for receiving screws 43 used to secure the jamb boot to the bottom of a wooden jamb.

A traditional wooden jamb 37 has a square-cut bottom end 35 and is aligned with and secured atop the flat, level upper face 24 of the jamb boot 21. The exterior profile of the jamb boot 21 preferably is configured to match or at least aesthetically complement the exterior profile of the jamb 37 such that when the jamb is attached to the jamb boot, the jamb boot visually appears as a short downward extension of the jamb. Preferably, the jamb is secured to the jamb boot by means of screws 43 that extend through the jamb boot from the bottom thereof and into the bottom end of the jamb.

A length of weather strip 39 is attached in the traditional way to the jamb extending along the stop 38 thereof for engaging and sealing against a closed door of the entryway. The weather strip in this embodiment projects downwardly a short distance from the bottom of the jamb and a portion of this projection 42 is received in the weather strip slot 23 formed in the jamb boot 21. The whether strip stiffener 36 then resides in the fold of the projection 42 of the weather strip to stiffen the weather strip in this region. The result of this stiffening is that the weather strip bears firmly against the bottom corner of a closed door and the front of the threshold cap 17 to resist leakage of water at this location, where leakage has heretofore been a significant problem. Further, the weather strip stiffener tends to hold the bottom of the weather strip open, which reduces its tendency to form a vertical capillary along which water may wick in a blowing rainstorm.

With the jamb boots secured to the ends of the threshold assembly and the jambs secured to the jamb boot, the resulting entryway frame can be hung with a door and installed in the usual way in a building to form an entryway. Since the jamb boots of the entryway, which are made of plastic, are the only portions of the jamb that contact the threshold assembly, rotting and deterioration due to moisture, insects, and the like is eliminated as are problems caused by wicking of moisture into the naked bottom ends of wooden jambs. In addition, the weather strip stiffener 36 provides enhanced sealing at the lower corner of a closed door where leakage is a problem and water that may seep into the channel beneath the threshold cap is drained away from the assembly and out the drain port 28.

Figure 3:
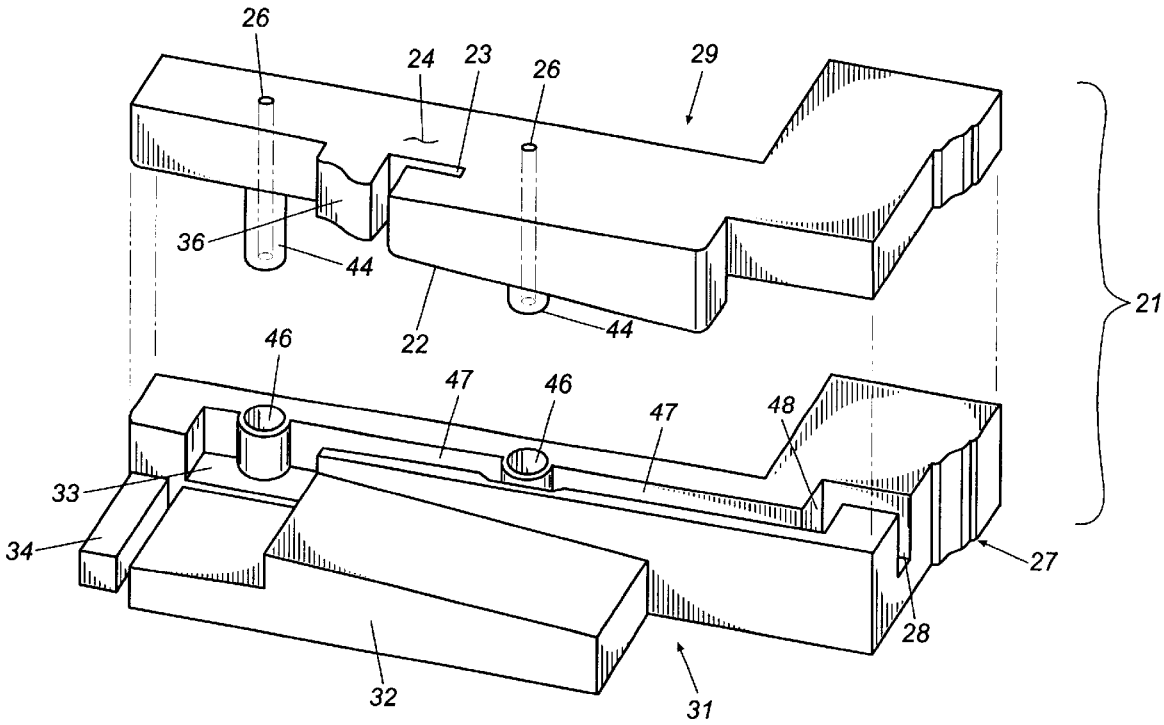
FIG. 3 is an exploded perspective view of a jamb boot that embodies principles of the invention and illustrating the internal drain channel formed therein.

FIG. 3 is an exploded perspective view of the jamb boot 21 of this invention showing the upper section 29 exploded away from the lower section 31 to reveal the structure of the drain built into the boot. A drain channel 47 is formed in the lower section 31 of the boot and extends generally from a mouth 33, through the lower section of the boot, to a drain port 28 on the front of the boot. An offset 48 is formed in the channel 47 adjacent the port 28. The purpose of the offset is to provide a primary barrier against water from windblown being blown backwards through the drain channel 47 and into the threshold cap channel of the threshold assembly. A secondary vertical barrier 51 (FIG. 4) is also provided to enhance resistance to this phenomenon.

In the illustrated embodiment, the upper section 29 of the jamb boot is formed with a pair of alignment posts 44 that depend therefrom. The lower section is formed with a corresponding pair of alignment holes 46 sized to receive the alignment posts 44 for aligning the upper and lower sections of the jamb boot as they are secured together. Preferably, the screw holes 26 extend through the alignment posts for receiving the attachment screws. While this particular arrangement is preferred, a variety of different configurations of alignment pins and screw holes are possible all within the scope of the invention.

Figure 4:
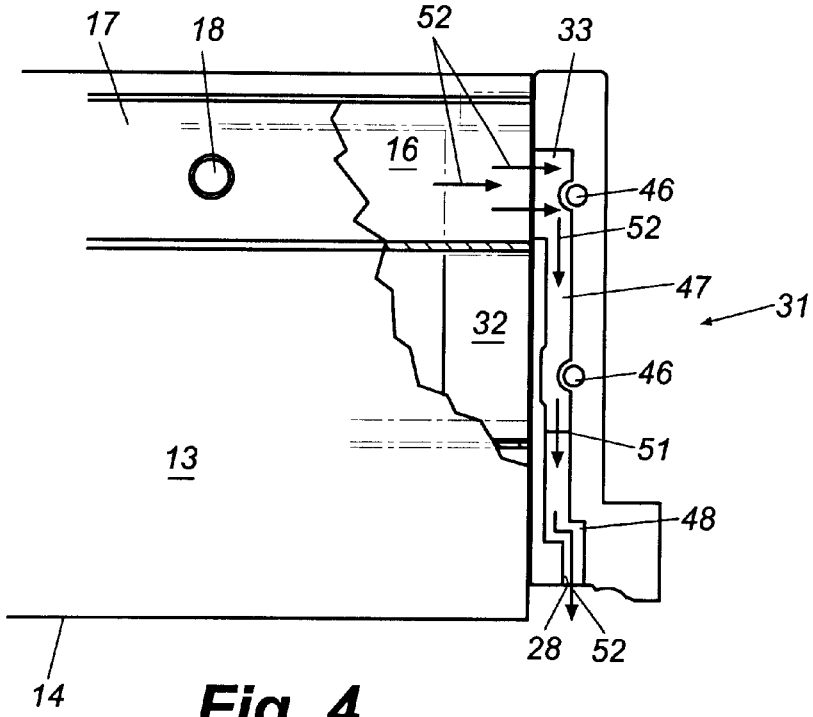
FIG. 4 is a top plan partially cut-away view of an end of the threshold assembly illustrating attachment of the boot and the draining of water from beneath the threshold cap.

FIG. 4 illustrates the draining feature of the jamb boot of the present invention. Only the lower section 31 of the jamb boot is shown in FIG. 4 for clarity of description and a portion of the threshold frame and threshold cap are cut away to show 1 internal structures thereof. The frame of the threshold assembly is formed with an upwardly open channel 16 that receives the threshold cap 17. A sill 13 slopes outwardly and downwardly from the channel 16 to a forward edge 14. The support and attachment block 32 of the jamb boot extends into a corresponding channel formed in the bottom of the extruded frame and is secured with staples or other appropriate fasteners. When so attached, the floor of the channel 16 meets the mouth 33 of the drain channel 47 and, in practice, a bead of sealant may be applied at the junction of the two during assembly to prevent leakage.

In the event that water should seep into the channel or simply form there as a result of condensation in certain weather conditions, the water, indicated at 52, flows to the ends of the channel 16, enters the drain channel 47 at the mouth 33 thereof, and is directed by the drain channel 47 to the port 28, where the water is deposited and drains away from the entryway. The vertical barrier or step 51 formed in the floor of the drain channel, in conjunction with the barrier 48, insures that while water may flow freely down the channel and away from the entryway, it cannot be blown by wind in a storm or the like back up the drain channel and into the threshold cap channel. Thus, any water that becomes trapped in the threshold cap channel drains easily therefrom through the drain channel.

The general principle of the jamb boot described above applies also to mull boots at the bottoms of mull posts of sidelight or double doorways. Such a mull boot preferably is formed of injection molded plastic material and has a bottom face that is haunched to sit on the extruded frame of the sill and present a flat, level upper face for attaching a square-cut bottom end of a mull post. Rot and decay is avoided and specially milled mull posts with custom mull haunches, as have been required in the past, do not have to be manufactured.

Figure 5:
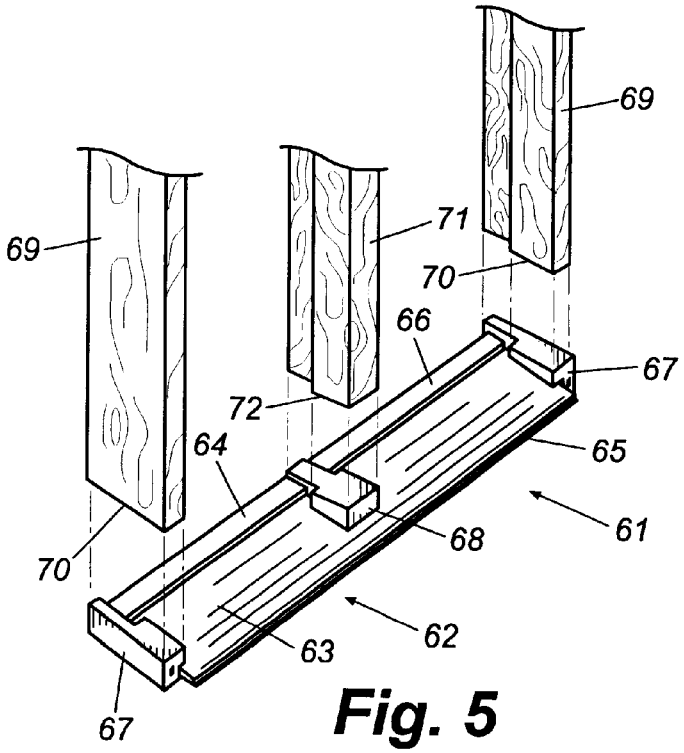
FIG. 5 is a perspective view of an entryway that includes a mull post and mull post boot according to the present invention.

FIG. 5 illustrates application of the jamb and mull boots of the present invention to a double opening entryway, which may, for instance, be an inswing entryway, an outswing entryway, a sidelight entryway or another type of entryway with multiple openings separated by mull posts The threshold assembly 61 has a forward edge 62 and a sill 63. Jamb boots 67, as described above, are attached to the ends of the threshold assembly and receive the bottom ends 70 of vertical jambs 69 as shown. A mull boot 68 according to the invention is secured atop the sill 63 and receives the bottom end 72 of a mull post 71 as previously discussed. Thus, the jambs and the mull post define and entryway with two openings. Caps 64, which may be threshold caps, sidelight caps, or other otherwise, are supported in the channel of the threshold assembly in the usual way to underlie doors and/or sidelight panels mounted in the openings.

The invention is applicable to the illustrated and virtually any type of traditional entryway system where wooden frame components traditionally have mated with the threshold assembly. With the system of the present invention, pre-hangers are no longer required to mill and stock special jambs and mulls for different types of entryways. Instead, the threshold assembly with its jamb and mull boots addresses these differences and the pre-hanger need only stock jamb and mull posts with square-cut bottom ends. Further, with proper sizing of the jamb and mull boots, only one standard length of jamb and mull post is required to fit a wide variety of entryway systems. Furthermore, rot is eliminated and standing water in the threshold cap channel drains harmlessly from the entryway.

Figure 6:
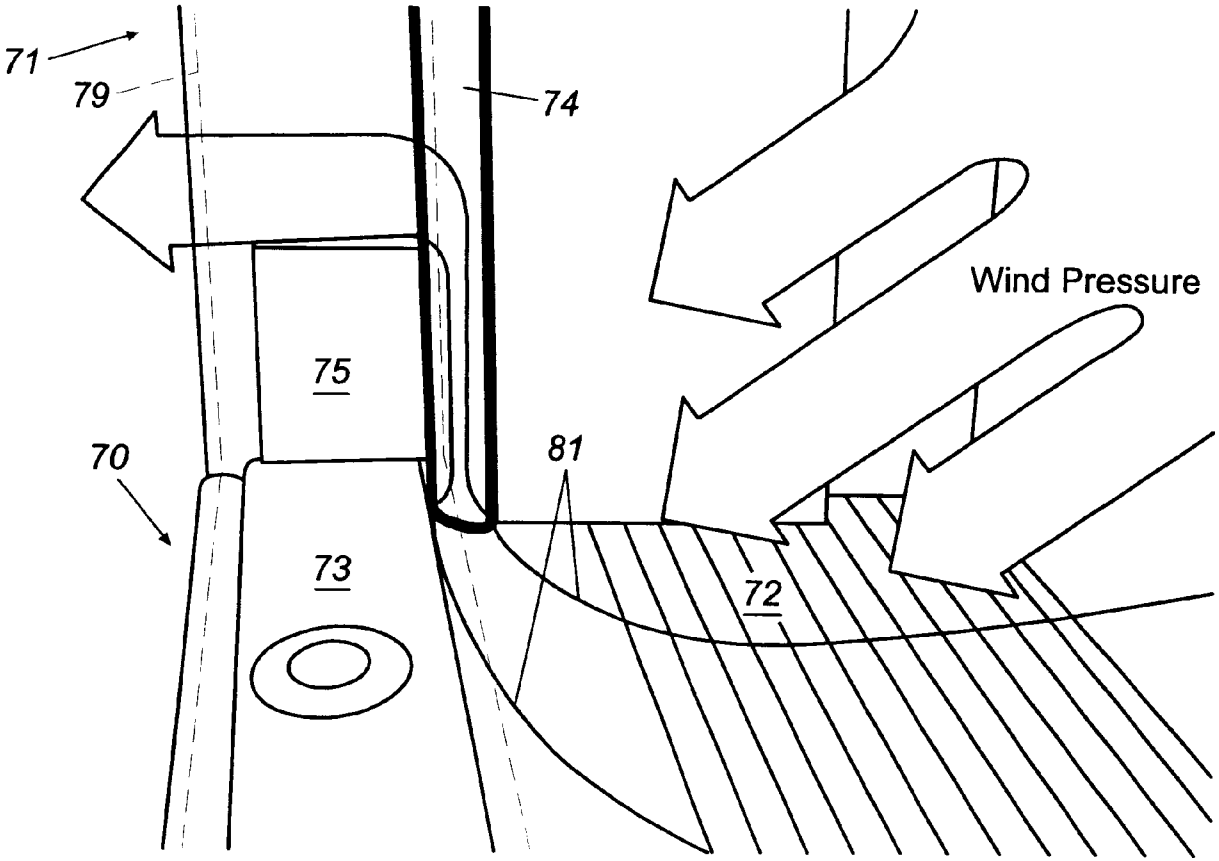
(Prior Art) Fig. 6
FIG. 6 is a perspective illustration showing the bottom corner of a traditional entryway system and illustrating the problem of weather strip wicking.
Figure 6A:
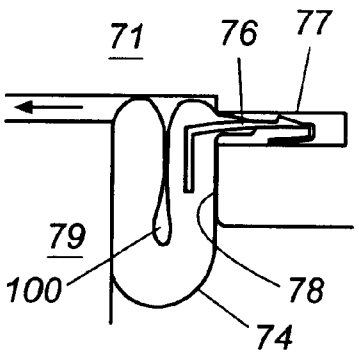
FIG. 6*a* is a cross-sectional view of a weather strip of FIG. 6 illustrating the formation of a capillary therein when the weather strip is compressed by a closed door.
Figure 7:
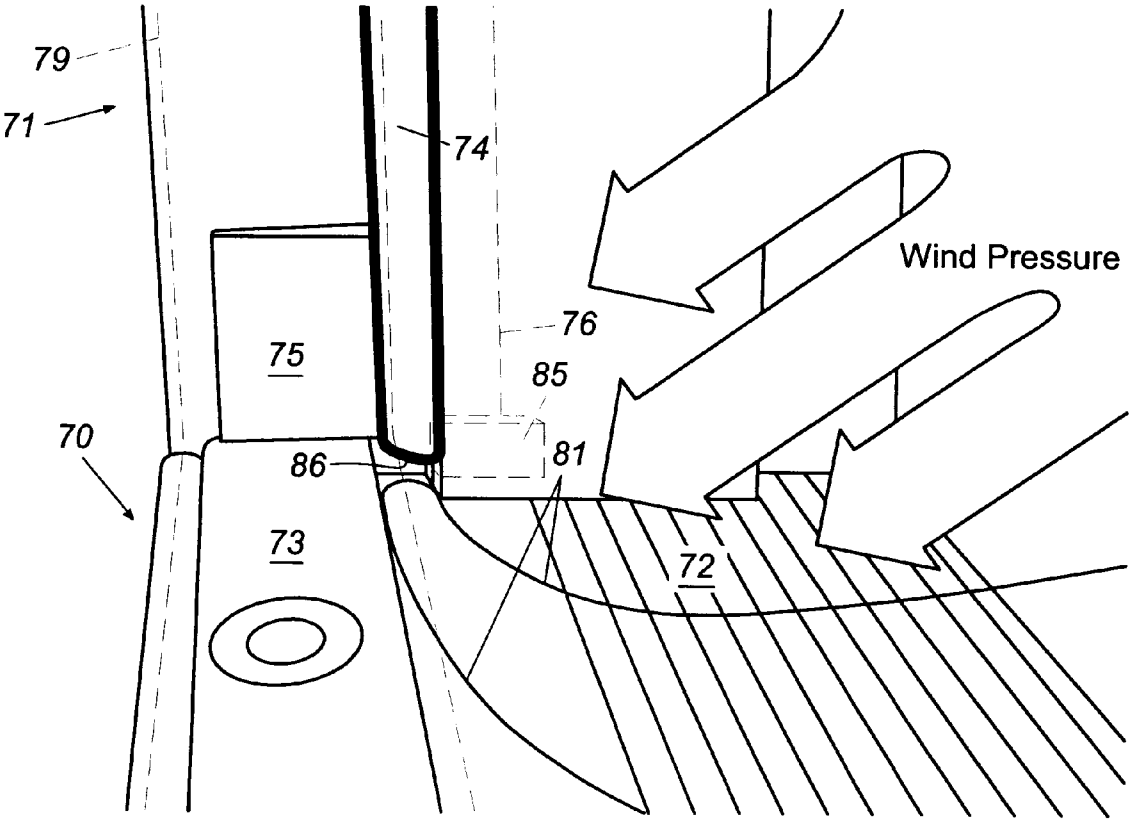
FIG. 7 is a perspective illustration showing the bottom corner of an entryway provided with a positioning insert according to the invention to raise the bottom end of the weather strip above the sill to prevent wicking.
Figure 7A:
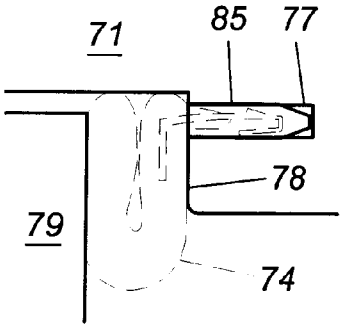
FIG. 7*a* is a cross sectional view of the weather strip of FIG. 7.

FIGS. 7 and 7*a* illustrate another aspect of the present invention for addressing the problem of corner leakage caused by weather strip wicking, as discussed above relative to FIG. 6. In FIG. 7, this aspect of the invention is illustrated as it may be applied to a traditional milled wooden jamb where the jamb mates with and is attached to an end of the threshold. An entryway has a threshold assembly 70 to the end of which a vertically extending framing member in the form of a vertical milled wooden jamb 71 is attached. Alternatively, the framing member could be a vertically extending mull post of an entryway. The term "framing member" is used herein and in the claims to refer to a member that may either be a mull post or a jamb. While the invention is described in the following discussion as being used in conjunction with door jambs, it will be understood that it is equally applicable to the mull posts of an entryway, such as a sidelight entryway, wherein a hinged door is mounted in an opening framed at least partially by mull posts rather than jamb. Referring again to FIG. 7, as is traditional, the jamb 71 is milled to define a vertically extending stop 78 (FIG. 7*a*) against which a closed door rests when shut. The bottom end of the jamb 71 is milled to define an angled haunch that is configured to sit atop the sloped sill 72 of the threshold assembly 70 in the usual way.

As best illustrated in FIG. 7*a*, the stop 78 is formed with a kurf 77 that extends along the length of the stop and receives the attachment tongue assembly 76 of a weather strip 74. The weather strip 74 is thus secured to the jamb extending along the stop and is collapsed and compressed between a closed door and the stop when the door shuts to form a seal around the periphery of the door. In the embodiment of FIG. 7, a traditional corner pad 75 is installed on the bottom portion of the jamb 71 for sealing the space between the bottom corner portion of a closed door and the jamb when the door is shut. The corner pad 75 may have a lobe that projects behind the weather strip 74 to stiffen the weather strip and thereby provide an enhanced seal at the lower corner of the door.

A positioning insert 85 is disposed in and fills the lower most extent of the weather strip kurf 77. The positioning insert may be fabricated of wood, plastic, or any suitable material that is compatible with the material of the jamb. When the weather strip 74 is installed by an original manufacturer or pre-hangar or is replaced after having been removed by a painter or carpenter, the positioning insert 85 limits the downward extent of the weather strip 74 by engaging the bottom of the weather strip's attachment tongue 76. As result, the bottom end 86 of the weather strip 74 is positioned by the positioning insert 85 at a location above and spaced from the surface of the jamb 72. The width or height of the positioning insert 85 and thus the resulting space between the bottom end 86 of the weather strip and the sill 72 is selected such that puddling water on the sill does not contact the bottom end 86 of the weather strip even under extremely high wind and wind pressure conditions.

Surprisingly, it has been found that the raising of the bottom end of the weather strip above the sill in conjunction with, or even without, a corner pad 75 eliminates much of the water leakage at the critical bottom corners of a closed door. Specifically, the corner pad 75 insures a tight seal between the edge of the door and the jamb and between the bottom of the weather strip and the bottom front face of the door. Raising of the bottom end 86 of the weather strip effectively eliminates any wicking of water up the weather strip and over the top of the corner pad. This solution has been tested in test chambers under extreme conditions of rain and wind and has proven to be surprisingly successful at preventing leakage. Further, the positioning insert 85 insures that if the weather strip is replaced for any reason, the critical spacing between the bottom of the new weather strip a sill will be maintained.

Figure 8:
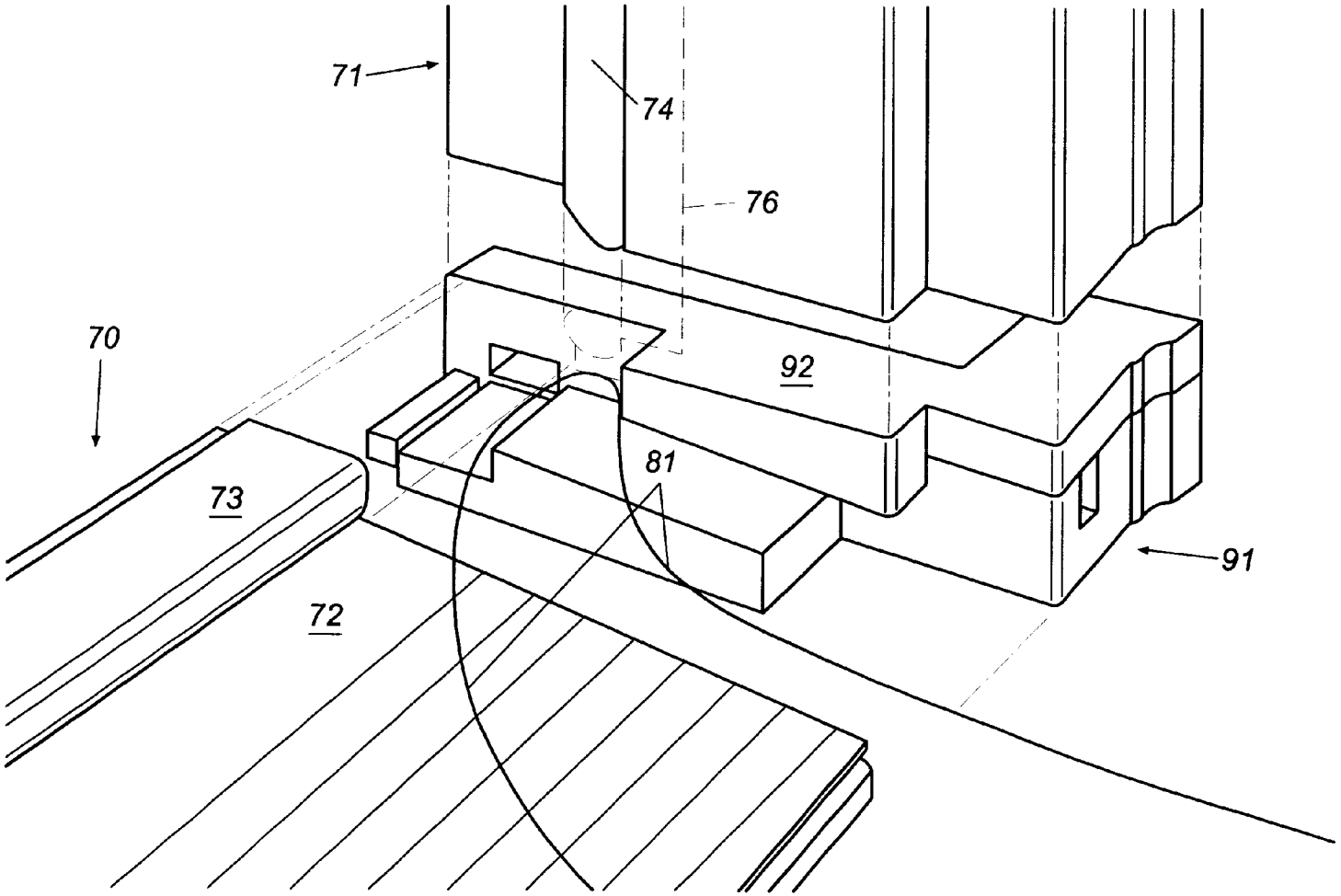
FIG. 8 is a perspective exploded illustration showing the anti-wicking feature of the present invention applied to a jamb boot of the invention.

FIG. 8 illustrates the raised weather strip aspect of the present invention implemented in an entryway system with a jamb boot such as the boots described with respect to FIGS. 1–5. The jamb boot 91 is fitted and secured to an end of the threshold assembly 70 as previously described. The jamb boot 91 has a flat level upper surface 92 to which the square cut bottom end of a traditional jamb 71 is mated and attached as previously described. In this embodiment, however, the jamb boot 91 is formed without the weather strip slot 23 and weather strip stiffener 36 illustrated and described with respect to FIG. 2. As a result, when the jamb 71 is attached to the jamb boot 91, the top surface of the jamb boot terminates the weather strip kurf formed within the jamb thereby forming a stop. When the weather strip 74 is installed by inserting its attachment tongue within the kurf of the jamb, the lower most extent of the bottom end of the weather strip is limited by the jamb boot as illustrated in dotted lines in FIG. 8. Consequently, when the entryway is fully assembled, the bottom end of the weather strip 74 is positioned a pre-determined distance above the deck of the sill 72. Wind blown water 81 therefore does not engage the bottom of the weather strip and, as a consequence, water is not wicked up the weather strip by exterior wind pressure. It has been found that such an arrangement substantially reduces leakage at the bottom corners of a closed door even in situations where a corner pad is not used to stiffen the bottom portion of the weather strip. Accordingly, the present invention successfully addresses and solves an age old problem with modern entryways; that is, the leakage of rainwater into a building at the bottom corners of a closed door.

The invention has been described herein in terms of preferred embodiments and methodologies. It will be understood by those of skill in the art, however, that a wide variety of additions, deletions, and modifications might be made to the illustrated embodiments without departing from the spirit and scope of the invention as set forth in the claims.

What is claimed is:

1. In an entryway having an opening defined by spaced vertically extending framing members, a threshold assembly spanning the bottoms of the framing members and having a sloping sill deck, a header spanning the tops of the framing members, a hinged door closable within the opening and having an outside face, and weather strips extending along the framing members for sealing against the outside face of the door when closed, the improvement wherein said weather strips have bottom ends that are spaced a predetermined distance above said sill deck of said threshold assembly to prevent windblown water on said sill deck from moving up said weather strips and leaking through said opening and wherein each of said vertically extending framing members is formed to define a raised stop having a kurf extending therealong, said weather strips including a leg extending into said kurf to mount said weather strips to said framing members extending along said raised stop, and further comprising a discontinuity at the bottom of each of said kurfs to space the bottoms of said weather strips above said sill deck.

2. The improvement of claim 1 and wherein said discontinuity is formed by an insert disposed in the bottom of each of said kurfs.

3. The improvement of claim 1 and wherein said discontinuity is formed by boots on said threshold assembly, said vertically extending framing members resting atop said boots.

* * * * *